US005367225A

United States Patent [19]

Pacholok et al.

[11] Patent Number: 5,367,225

[45] Date of Patent: * Nov. 22, 1994

[54] HIGH FREQUENCY LUMINOUS TUBE POWER SUPPLY HAVING NEON-BUBBLE AND MERCURY-MIGRATION SUPPRESSION

[75] Inventors: David Pacholok, Sleepy Hollow, Ill.; David Doss, deceased, late of Overland Park, Kans.

[73] Assignee: Everbrite, Inc., Greenfield, Wis.

[ * ] Notice: The portion of the term of this patent subsequent to Feb. 23, 2010 has been disclaimed.

[21] Appl. No.: 15,545

[22] Filed: Feb. 9, 1993

Related U.S. Application Data

[63] Continuation-in-part of Ser. No. 750,530, Aug. 27, 1991, Pat. No. 5,189,343.

[51] Int. Cl.[5] ..... H05B 37/02

[52] U.S. Cl. ..... 315/219; 315/176; 315/209 R; 315/DIG. 5

[58] Field of Search ..... 315/219, 209 R, 176, 315/DIG. 5, DIG. 7, 246, 171, 172, 226

[56] References Cited

U.S. PATENT DOCUMENTS

| | | | |
|---|---|---|---|
| 3,789,266 | 1/1974 | Polman et al. | 315/DIG. 7 |
| 4,933,605 | 6/1990 | Quazi et al. | 315/DIG. 5 |
| 5,189,343 | 2/1993 | Pacholok | 315/219 |

*Primary Examiner*—Robert J. Pascal
*Assistant Examiner*—Michael B. Shingleton
*Attorney, Agent, or Firm*—Maksymonko & Slater

[57] ABSTRACT

A high frequency power supply for neon and mercury luminous tubes including means for simultaneously suppressing bubbles formed in neon tubes and for minimizing migration of mercury commonly associated with the use of solid-state luminous tube power supplies.

7 Claims, 8 Drawing Sheets

HIGH FREQUENCY LUMINOUS TUBE POWER SUPPLY HAVING NEON-BUBBLE AND MERCURY-MIGRATION SUPPRESSION

This application is a continuation-in-part of application Ser. No. 750,530 filed Aug. 27, 1991, now issued as U.S. Pat. No. 5,189,343. Application Ser. No. 875,030 filed Apr. 28, 1992 is a divisional application of Ser. No. 750,530. All three applications are presently, and were at the time of the inventions thereof, commonly owned by the present assignee.

BACKGROUND OF THE INVENTION

The present invention relates to high frequency power supplies for use with luminous tubular glass signage of the type often found in connection with retail advertising and decorating. More particularly, the present invention is specifically designed to power luminous tube signage of either the neon or mercury gas variety or, as is often the practice, signs having luminous tube segments of both gas types.

Until the relatively recent development of high frequency power supply technology, luminous tube signs (generally referred to generically as "neon signs" regardless of the actual gas employed), were uniformly powered by relatively massive low frequency (e.g. 60 Hz) high-voltage transformers, such transformers being both large and heavy.

High frequency power supplies (of which the present specification relates) offer significant reductions in both size and weight as compared to this older low frequency transformer technology. But not unexpectedly, there are inevitable trade-offs—in the present case, the concomitant liabilities of "neon bubble formation" and "mercury atom migration", problems uniquely associated with high frequency excited luminous tubes.

By way of additional background it should be observed that "neon" is, in fact, a misnomer. As previously noted, mercury is an equally common gas used in so-called "neon" signage. In fact, neon is only used in those signs, or those portions of signs, in which the 'warm' colors of red, orange, pink and some shades of purple are desired. Where 'cool' colors are intended, e.g. blue, turquoise and white, mercury is employed.

The visible spectral radiation of mercury may be employed directly as the visible medium or, as commonly, the ultraviolet radiation of mercury may be used in an indirect manner to excite phosphor coatings as required to produce the desired colors. It is significant to the present invention that many signs employ both neon and mercury luminous tube segments. It is therefore necessary that the present high frequency supply properly excite luminous tubes of either or both gas types.

The difficulty imposed by the foregoing is that mercury and neon are very different elements and therefore impart correspondingly dissimilar demands on their associated high frequency power sources. Neon, for example, remains a gas at room temperature while mercury is a liquid of low vapor pressure. Neon is relatively inert and therefore does not form chemical compounds. Mercury, by contrast, is very reactive and may combine with oxygen in the air to form, for example, various solid oxides. Such inherent differences result in the unique problems of neon bubble formation and mercury gas migration, as discussed in more detail below, and the corresponding difficulty in designing a high frequency power supply suitable for use with both gas types.

The principal difficulty with high frequency excited mercury tubes is that of "mercury migration". Current flow in mercury tubes is defined principally by movement of positive mercury ions. These ions are attracted to the negative electrode at which point they are neutralized to become mercury atoms. In principle this mechanism of current flow and ion neutralization should pose no difficulty as the 'alternating' nature of the high frequency supply guarantees that each of the opposed tube electrodes is, in turn, negative and therefore receives its 'share' of mercury ions. No net accumulation of mercury ions should be anticipated at either electrode. The density and distribution of mercury ions and atoms throughout the tube should remain substantially uniform. This is, in fact, the case where mercury tubes are excited by conventional low frequency 60Hz power sources.

In practice, however, the use of high frequency power sources has been observed to cause the slow migration of mercury ions and atoms to one end of the tube. And due to the low vapor pressure of mercury, the redistribution and equalization of the mercury atoms through Brownian motion cannot be assured. As a consequence, one end of the tube is eventually depleted of the mercury gas required for light production thereby causing that end to grow dark.

The causes and solutions to the migration problem in high frequency excited mercury tubes is, at least in part, understood. One known cause is that of an overall or residual direct current (DC) component through the tube. Unfortunately, as outlined below, such DC components are often deliberately introduced in connection with neon tube high frequency power supplies as a solution to the bubble formation problem common with neon gas signs. Here, then, is one example of the difficulty known to the art in providing a single high frequency power supply suitable for use with both neon and mercury gas tubes. The 'cure' for the neon bubble problem—i.e. the introduction of a small DC component—assures the ultimate discoloration or darkening of any mercury tube connected thereto.

It has also been discovered that the excitation of a mercury tube with a pure alternating current (AC) waveform—i.e. one without any residual DC component—may still cause mercury migration in the event that such waveform exhibits any asymmetry. Although the average positive and negative tube currents may be the same (again, no DC component), where the respective positive and negative half-cycles are not substantially identical, non-linearities associated with gas ion transit times or other tube phenomena result in the migration of the mercury atoms therein. Again, the solution to the migration problem—the use of an absolutely symmetrical AC waveform —is precisely the waveform that assures the greatest production of objectionable bubbles in neon gas tubes.

As noted, neon and mercury are quite different gases. Neon does not suffer from the ion/atom migration problem and therefore there is no corresponding restriction against the use of DC or non-symmetric AC power supply waveforms. Neon, however, has its own unique problem of bubble formation. Indeed, as discussed in U.S. Pat. No. 4,862,042 to Herrick, this phenomenon is well known and, in the cited reference, the deliberate introduction of DC currents is exploited to produce certain selected visually desirable effects associated with bubble formation and controlled movement of the bubbles within the neon tube.

These effects, however, are of limited and special application. In connection with the fabrication of ordinary neon signs, the presence of neon bubbles disrupts the uniform bar appearance of the elongated neon tube and is considered highly undesirable. As noted above, applying either a small DC bias through the neon tube or a non-symmetric waveform will force the relatively rapid motion of the bubbles, in turn, causing the bubbles to disappear, at least as perceived by the human eye.

The present invention seeks to simultaneously eliminate both the mercury migration and neon bubble formation problems thereby resulting in a high frequency supply that may be interchangeably used with tubes of either construction or, more commonly, with signs having tube segments of both gas types.

More specifically, the present invention relies on the discovery that the respective problems exhibit dissimilar time constants, that is, mercury migration generally requires a period of hours if not weeks or months to develop while neon bubble formation occurs substantially instantaneously. Thus, the present invention seeks to produce a DC or asymmetrical component of sufficient duration to visually defeat bubble formation while simultaneously assuring no long-term DC or asymmetrical component.

Several embodiments are proposed. In one embodiment, a zero DC component non-symmetrical waveform is generated with the asymmetry of this waveform being automatically and periodically reversed. In this manner, the applied waveform remains continuously non-symmetrical thereby assuring bubble invisibility while the long-term symmetry afforded by the periodically reversing asymmetry minimizes or eliminates all mercury migration. The arrangement proposed achieves this result at minimal circuit complexity and expense, specifically, by causing the requisite reversal within the low voltage driver portion of the supply thereby eliminating any relays or other high voltage switching components.

In an alternative arrangement, a DC biased symmetrical AC waveform is proposed in which the sense or polarity of the DC bias is, again, reversed at an appropriate long-term periodic rate. In this manner, minimum mercury migration is assured through application of AC symmetry and zero net DC bias over the long-term. The preferred embodiment employs a square-wave reversal of the DC bias. Although other waveforms, such as sine waveforms, may be utilized, the present approach minimizes circuit complexity by avoiding the bulk and cost of, for example, additional 60Hz transformers or windings and, further, provides better bubble elimination. In this latter connection, the zero-crossing points of non-square wave DC bias reversal sources define partial bubble formation regions with correspondingly poorer bubble suppression capabilities.

More specifically, the preferred arrangement seeks to employ the series current fed push-pull resonant oscillator which is well known in the fluorescent ballast industry. In the present application, the oscillator output incorporates a leakage reactance output step-up transformer which, in turn, drives the neon or mercury load.

Certain difficulties were encountered, however, when this supply was connected to neon tube loads. A parasitic low frequency oscillation was observed which, as best understood, was controlled by the ionization time constant of the neon gas in concert with the series current feed choke as coupled through the leakage output transformer.

This oscillation was observed to build in intensity, often causing an over-voltage failure of the switching oscillator transistors. A further and most annoying problem resulting from this low frequency parasitic oscillation was that of an audible power supply squeal.

The present invention therefore seeks to implement the low cost series current fed oscillator through employment of a novel parasitic oscillation suppression arrangement. In this arrangement, a second winding is positioned and coupled to the series current feed choke and energy, related only to the parasitic oscillation, is coupled, rectified, and returned to the DC power source in a manner that both suppresses the unwanted oscillation but without the normal power losses associated with known suppression schemes.

A further feature of the present reversing DC current migration/bubble elimination high frequency oscillator is that of the output DC current switching circuitry. While it is generally known that residual DC tube currents cause mercury migration, and that the reversal of such currents minimize this migration, known current reversing arrangements have not been totally satisfactory, either due to cost or circuit efficacy. As noted above, for example, use of a series connected 60 Hz transformer is not believed to fully quench bubble formation and, in any event, is contrary to the underlying objectives associated with high frequency power supplies in its re-introduction of a relatively bulky 60 Hz transformer.

With specific reference to the present invention, DC current reversal is achieved through the switching of a diode element in alternate polarities across a reactance element in series with the reactance transformer output. The diode serves to shunt the reactance for current flow through the secondary in one direction only thereby generating the previously noted DC off-set current. By reversing the polarity of the diode, a corresponding reverse in neon tube DC current results.

The present invention, however, avoids the complexity and costs associated with multiple switching devices and diode elements ordinarily required to implement the required reactance polarity switching. Instead, an arrangement of two FET devices provides both the switching and diode functions by advantageously employing an intrinsic diode defined within the FET structure when the FET is in the off condition. Thus each FET alternately performs a switching and a diode current shunting function thereby resulting in a high performance mercury migration elimination circuit of minimum cost, complexity, and of corresponding increased reliability.

It is therefore an object of the present invention to provide a high frequency power supply suitable for use with either neon and/or mercury luminous tubes. Such supply should eliminate or minimize the formation of visible bubbles in neon tube segments and the migration of gas atoms in mercury tube segments thereby providing a efficacious high frequency power source suitable for exciting composite neon/mercury gas signs for substantially unlimited time periods. A further and important object is that such supply must be cost effective and reliable and consequently should avoid the use of additional and bulky 60Hz transformers or windings and/or high voltage relays or similar switching devices.

These and other objects will become apparent from the Drawings and the specification including the Description of the Preferred Embodiment that follow.

DESCRIPTION OF THE PREFERRED EMBODIMENT

Figure 1:
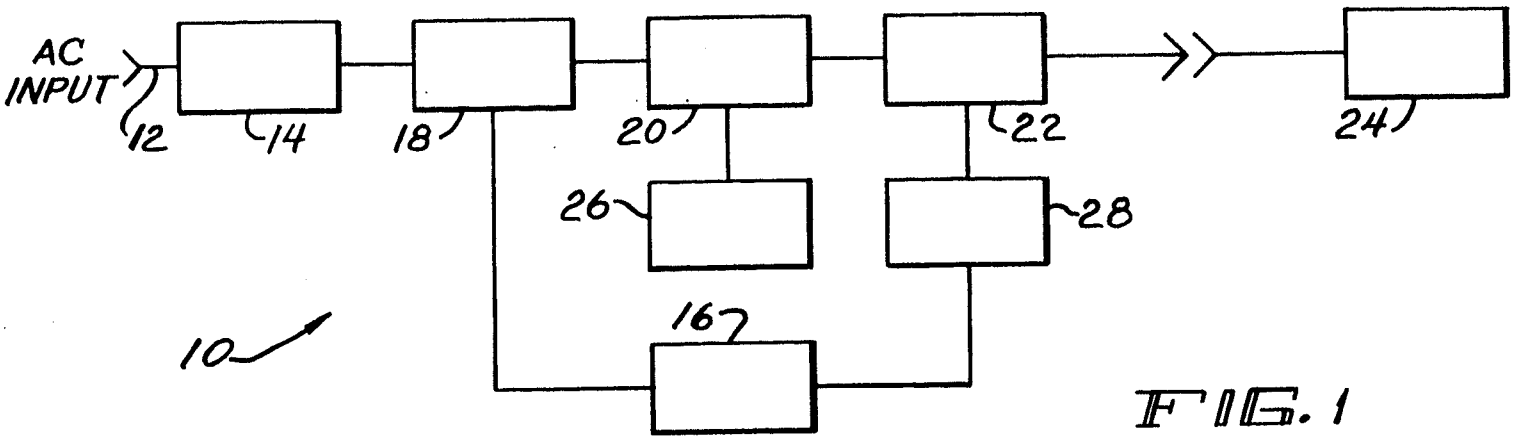
FIG. 1 is a block diagram of the symmetrical switched polarity DC current high voltage power supply of the present invention.

FIG. 1 illustrates a first embodiment 10 of the mercury migration and neon bubble elimination high frequency power supply of the present invention. Supply 10 is connected to a source of alternating current at 12 from, for example, standard 120 volt, 50/60Hz power mains. This AC power is, in turn, rectified and filtered at 14 in a conventional manner to provide a source of DC, typically about 160 volts, to operate the high frequency oscillator and other components described hereinafter.

Although not forming a part of the present invention, ground fault detection and supply shut-down circuits are provided in conformity with UL (Underwriter's Laboratories) standards and commercial practice. Ground fault circuitry includes a ground fault current detector and timer 16 and a switch 18 to interrupt or disconnect rectifier 14 power from the high frequency oscillator circuitry which, in turn, causes secession of all output voltage and current to the gas tube load.

The rectified DC voltage, as passed by switch 18, is connected to, and supplies the operating power required by, the series current-fed oscillator 20. Oscillator 20 operates with a resonant output, the inductive component of which is provided by output transformer 22. Transformer 22 is of the leakage reactance type and includes, as described in more detail below, a pair of series-connected secondary windings which are, in turn, connected to the neon and/or mercury gas tube load 24. As discussed in the Background section of the present specification, a suppressor 26 is integrally incorporated into oscillator 20 to eliminate low frequency parasitic oscillations otherwise found to occur. Suppressor 26 is described in more detail below. Also described below is the symmetrical DC current reverser 28 which, when interfaced with the above-noted pair of transformer 22 secondary windings, provides the required DC anti-bubble bias with periodic anti-migration phase reversal.

Figure 2:
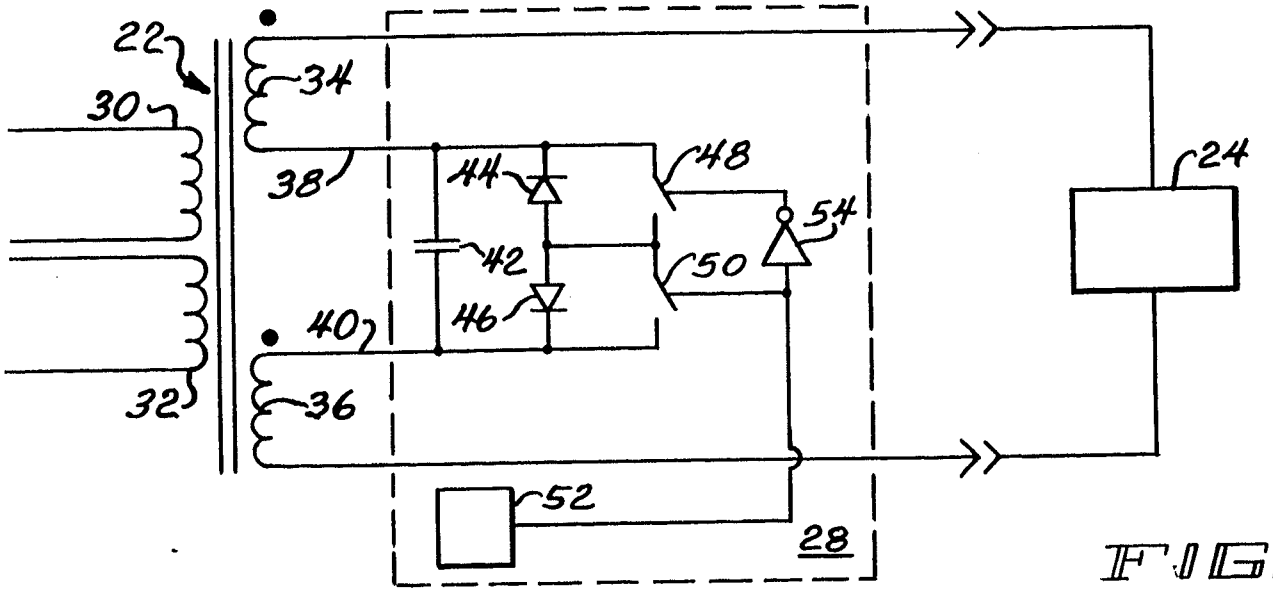
FIG. 2 is a partial schematic representation of the symmetrical DC current reversing anti-bubble/anti-migration circuitry of the power supply of FIG. 1.

FIG. 2 is an explanatory schematic diagram illustrating operation of the symmetrical DC current reverser 28 as well as its interconnection to reactance transformer 22. Transformer 22 incorporates generally conventional primary and feedback windings 30 and 32, respectively, and, as noted, a pair of secondary windings 34 and 36. These output windings are generally in a series-aiding configuration with the summed output thereof being connected to the neon/mercury gas tube 24. The respective center leads 38 and 40 of these windings, however, are not directly connected, but are interconnected through current reverser 28 shown within the dotted line of FIG. 2.

Reverser 28 comprises a reactive element 42, preferably a capacitor, placed in series with windings 34 and 36 and a pair of opposed, series-connected diodes 44 and 46 across capacitor 42. Reverser 28 operates by alternately shunting one of the diodes 44 and 46 which, in turn, places the remaining, non-shunted diode electrically across capacitor 42. Electronic switches 48 and 50 are placed across respective diodes 44 and 46 and are synchronously driven by a low frequency clock 52. Clock 52 may be of any convenient configuration and should have a frequency generally well-below that of the high frequency oscillator 20, the latter frequency typically being in the order of 20 Khz. In the preferred arrangement, the switch clocking signal is derived from the AC line input 12 (FIG. 1) and is therefore 50/60 Hz. An invertor 54 between the respective gate inputs of switches 48 and 50 assures that one switch, and only one switch, will be closed at any given instant, in turn, guaranteeing that one diode will electrically be in shunt across the capacitor at all times.

It will be appreciated that the effect of placing a diode across capacitor 42 is to create a low impedance current path for that half output cycle for which current is flowing in the direction of the diode and a higher impedance current path—increased by the reactance of the capacitor—for the half output cycle for which current is forced to flow contrary to the diode, that is, where the current must flow through capacitor 42. The resulting asymmetrical output current flow constitutes the superposition of symmetrical AC and quiescent DC current waveforms.

By reversing the sense or direction of the diode across capacitor 42, a corresponding reversal in the DC component of gas tube current results which, in turn, minimizes long-term mercury migration while simultaneously maintaining the requisite anti-bubble DC current component.

Figure 3:
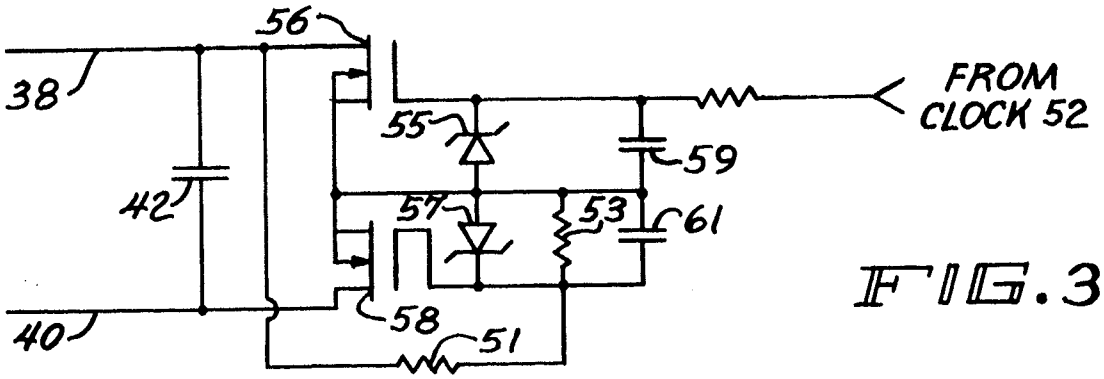
FIG. 3 is a schematic diagram of the symmetrical DC current reversing anti-bubble/anti-migration arrangement of the power supply of FIG. 1.

As previously indicated, FIG. 2 is merely illustrative of circuit operation. FIG. 3 represents the actual circuit topology of the preferred embodiment in which a pair of insulated gate FETs 56 and 58 are advantageously employed in the dual capacity as electronic switches and capacitor shunt diodes. Thus, for example, FET 58 performs the function of, and replaces, both the diode 44 and switch 48 (of FIG. 2). In addition this switching function, FET 56 serves as the invertor 54 of FIG. 2 required to drive FET switch 58. Resistors 51 and 53 couple the inverted output of FET 56 to the gate input of FET 58.

In similar fashion, diode 46 and switch 50 are replaced by FET 58. Zener diodes 55 and 57 protect the respective gate-source junctions against over-voltage. Twelve volt zeners are appropriate. Capacitors 59 and 61 serve to by-pass the gates of FET 56 and 58 for the high frequencies generated by oscillator 20. It will be appreciated that this dual and triple (in the case of FET 57) functionality represents a meaningful improvement in circuit simplicity with its corresponding improvement in reliability and reduction in cost.

Figure 4:
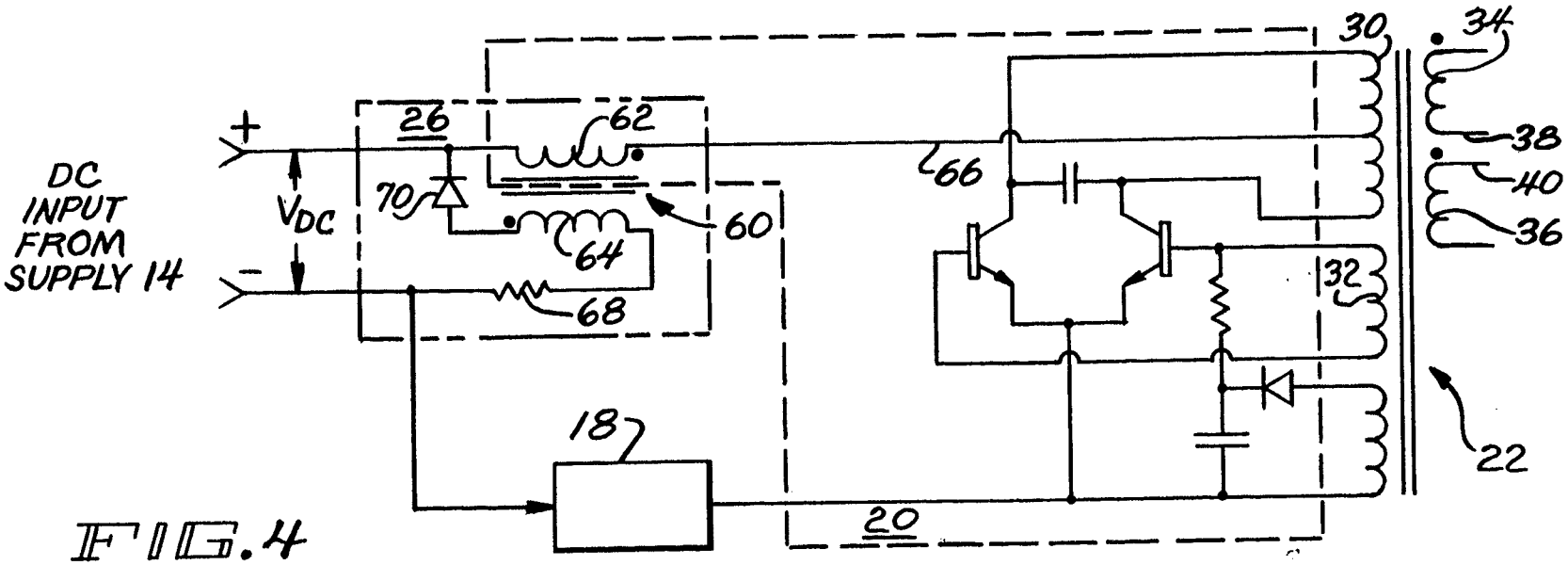
FIG. 4 is a schematic diagram of the series current-fed oscillator and parasitic oscillation suppression arrangement of the power supply of FIG. 1.

FIG. 4 is the schematic representation of the series current-fed oscillator 20 including output reactance transformer 22 and parasitic oscillation suppressor 26. Oscillator 20 is of generally conventional configuration and will not be discussed further herein except to note that the input choke required by such oscillators has been replaced by transformer 60 having primary and secondary windings 62 and 64, respectively.

Figure 5:
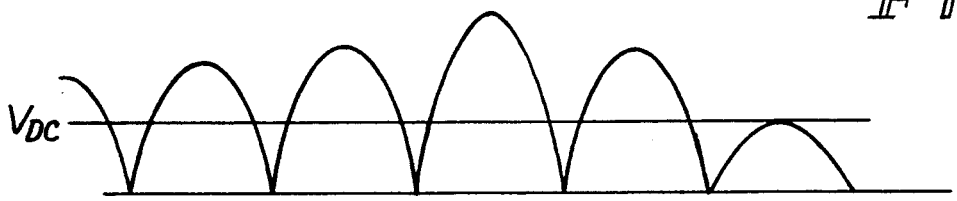
FIG. 5 is a waveform diagram illustrating the waveform at the output end of the input choke of the series-fed oscillator without the parasitic oscillation suppression of FIGS. 1 and 4.
Figure 6:
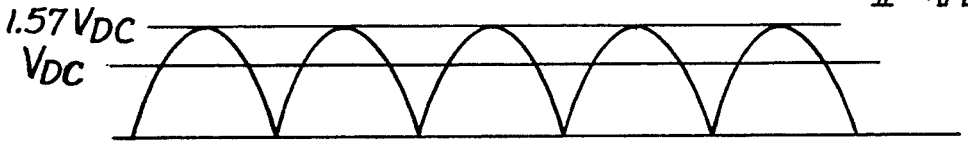
FIG. 6 is a waveform diagram illustrating the waveform at the output end of the input choke of the oscillator of FIGS. 1 and 4 with the parasitic oscillation suppression circuitry depicted in those figures.

Operation of suppressor 26 (FIG. 1 ) may best be understood by reference to the waveform diagrams of FIGS. 5 and 6. These diagrams depict the voltage waveform present at the output end 66 (FIG. 4) of series-fed oscillator input choke 62. As previously noted, choke 62 comprises the primary winding of transformer 60.

FIG. 6 illustrates the desired waveform of a series-fed oscillator. By contrast, FIG. 5 illustrates the waveform of a series-fed oscillator exhibiting an undesired low frequency parasitic oscillation condition. Such parasitic oscillations have been found in series-fed power supplies employing a reactance output transformer, such as transformer 22, and powering a neon gas tube, for example, neon Icad 24. As noted, the peak voltages caused by such oscillations often exceed the maximum ratings of the oscillator transistors and, in any event, result in an objectionable, audible whining or squealing noise. During normal and proper operation, the peak voltage is approximately $1.57V_{dc}$.

Referring again to FIG. 4, the secondary 64 of transformer 60 is connected in series with resistor 68 and diode 70, the combination of this series configuration being connected across the power supply input of voltage, $V_{dc}$. It will be observed that the polarity of diode 70 is such that any current flow through this diode, that is, any energy recovered by the parasitic oscillation suppressor 26 will be returned as useful power to the supply thereby effecting suppression without undue lost power dissipation.

Figure 7:
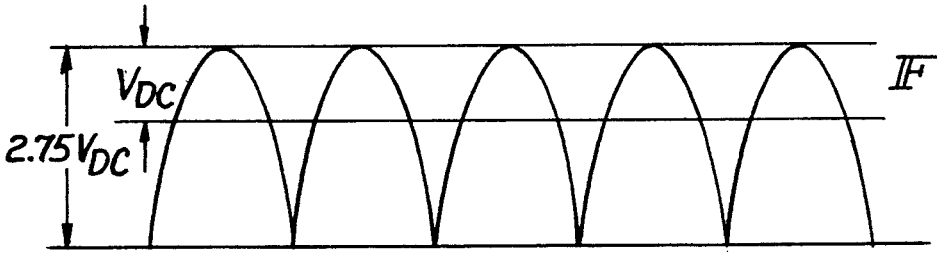
FIG. 7 is a waveform diagram illustrating the waveform across the secondary of parasitic suppressor transformer under normal and proper operation of the supply of FIG. 1.

FIG. 7 illustrates the desired waveform appearing across the secondary 64 of transformer 60 during normal oscillator operation (i.e. without any parasitic oscillation). As the peak positive voltage, $V_{dc}$, is equal to the supply voltage, no rectification or current flow through diode 70 will occur. However, in the event that any parasitic oscillation should develop, correspondingly higher peak positive voltages, i.e. in excess of $V_{dc}$, will occur thereby causing diode 70 to conduct. This conduction removes energy from the oscillator, thereby clamping the excess voltage peaks and damping the unwanted low frequency oscillation and, as noted, returning energy to the power source.

It will be observed that the desired secondary voltage requires a turns ratio of 1.75 to step up the voltage from 1.57 to 2.75. In fact, turns ratios of between 1.4 and 1.8 have been found satisfactory. Resistor 68 should be approximately equal to the input impedance of the series-fed oscillator at full load, although proper operation will be found over a wide range of values down to as low as 10% of the input impedance. For a 120 VAC power supply, the optimum value is about 150 ohms.

Figure 8:
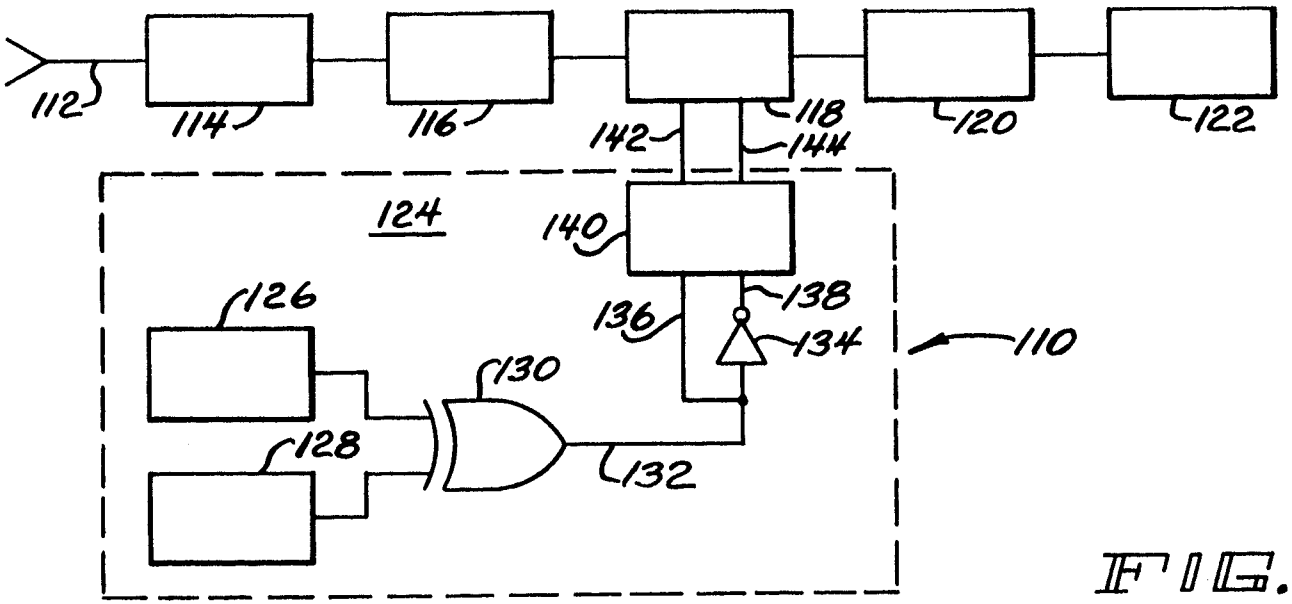
FIG. 8 is a block diagram of an alternative symmetrically reversing asymmetrical current embodiment of the present anti-bubble/anti-migration power supply.

FIG. 8 is a block illustration of a second embodiment of the anti-migration anti-bubble high frequency power supply 110 of the present invention in which no DC off-set bias is employed. Rather, an asymmetrical current is applied to the primary of the high voltage output transformer thereby eliminating neon bubble formation while the phase of this non-symmetrical input current is periodically reversed, at a relatively lower rate, to minimize or eliminate mercury migration.

As before, supply 110 is connected to a source of 120/240 volt, 50/60Hz AC mains 112 which, in turn, are connected to rectifier/filter 116 through an EMI (electromagnetic interference) filter 114. The DC output from rectifier/filter 116 is preferably about 360 $V_{dc}$. A half-bridge polarity reversing switcher 118 connects the DC supply voltage to the primary of output transformer 120, the output of which is connected to the neon/mercury gas tube load 122.

Figure 9:
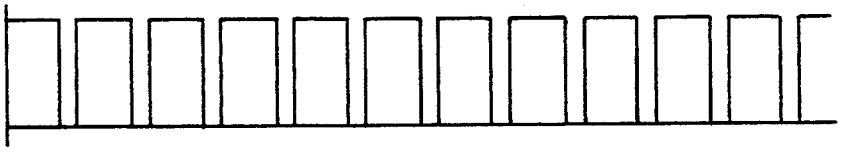
FIG. 9 is a waveform diagram of the output of the high frequency asymmetrical oscillator of the power supply of FIG. 8.
Figure 10:
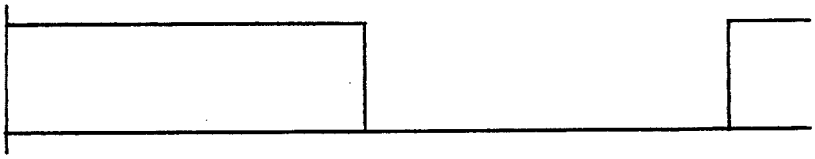
FIG. 10 is a waveform diagram of the output of the low frequency symmetrical oscillator of the power supply of FIG. 8.
Figure 11:
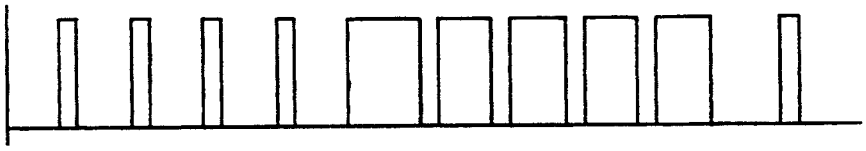
FIG. 11 is a waveform diagram of the high and low frequency oscillator outputs as combined by, and at the output of, the exclusive OR gate of FIG. 8.

Switcher 118 periodically reverses the current through the primary of output transformer 120 in accordance with switching signals generated by controller 124. More specifically, controller 124 includes a pair of oscillators 126 and 128, the outputs of which form inputs to exclusive-OR gate 130. Oscillator 126 is of comparatively high frequency (e.g. about 25 KHz) and of non-symmetric output waveform while oscillator 128 provides a symmetric low frequency output preferably in the order of about 1 Hz. These oscillators may be of conventional design with the lower frequency oscillator being free-running or, advantageously, being derived by digitally dividing the higher frequency oscillator output. FIGS. 9 and 10 illustrate the output signals generated by respective oscillators 126 and 128. FIG. 11 depicts the combination of the oscillator signals as the combination appears at the output 132 of, exclusive-OR gate 130.

Figure 12:
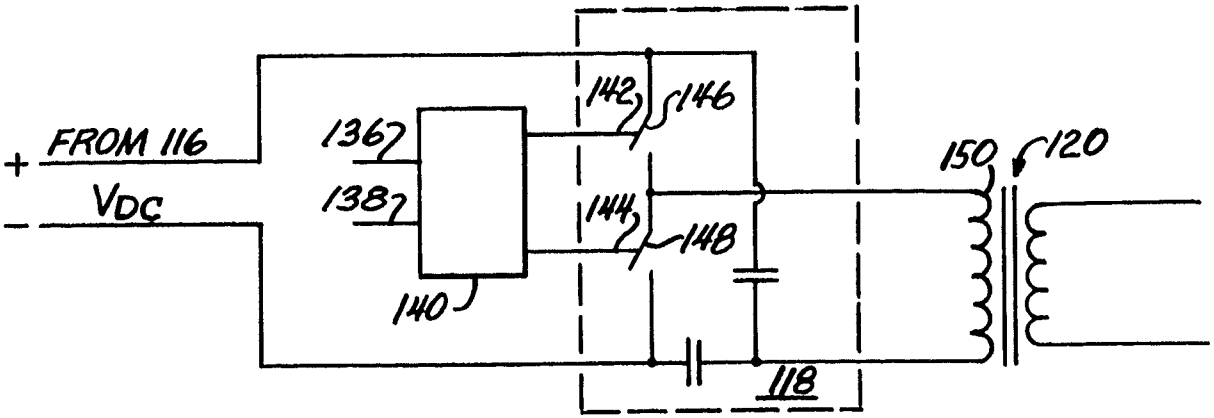
FIG. 12 is a partial schematic and block representation of the current reversing switch and switch driver of FIG. 8.

Gate 130 output is, in turn, inverted at 134 thereby providing complementary input signals 136 and 138 to switch driver 140. An International Rectifier IR-2110 integrated driver may be employed. With reference to both FIGS. 8 and 12, driver 140 includes complementary outputs 142 and 144 which, in turn, alternately gate respective current switches 146 and 148 "on" and "off" in conventional half-bridge fashion. In operation, the complementary outputs from driver 140 assure that only one of the switches will be "closed" or "on" at any given instant. Switches 146 or 148 are preferably FETs, for example, International Rectifier, IRF-830. It will be appreciated that the current through the primary 150 of output transformer 120 is reversed as a function which switch, 146 or 148, is enabled thereby forcing the transformer current waveform to generally track the switching signal output 132 of exclusive-OR gate 130 (FIG. 11). In this manner, a perpetually non-symmetric waveform is presented to the neon/mercury tube load which, as previously discussed, assures the visual elimination of neon bubbles while simultaneously providing a load current waveform of zero DC off-set and long-term overall symmetry. These latter characteristics further reduce or eliminate mercury migration.

Figure 13:
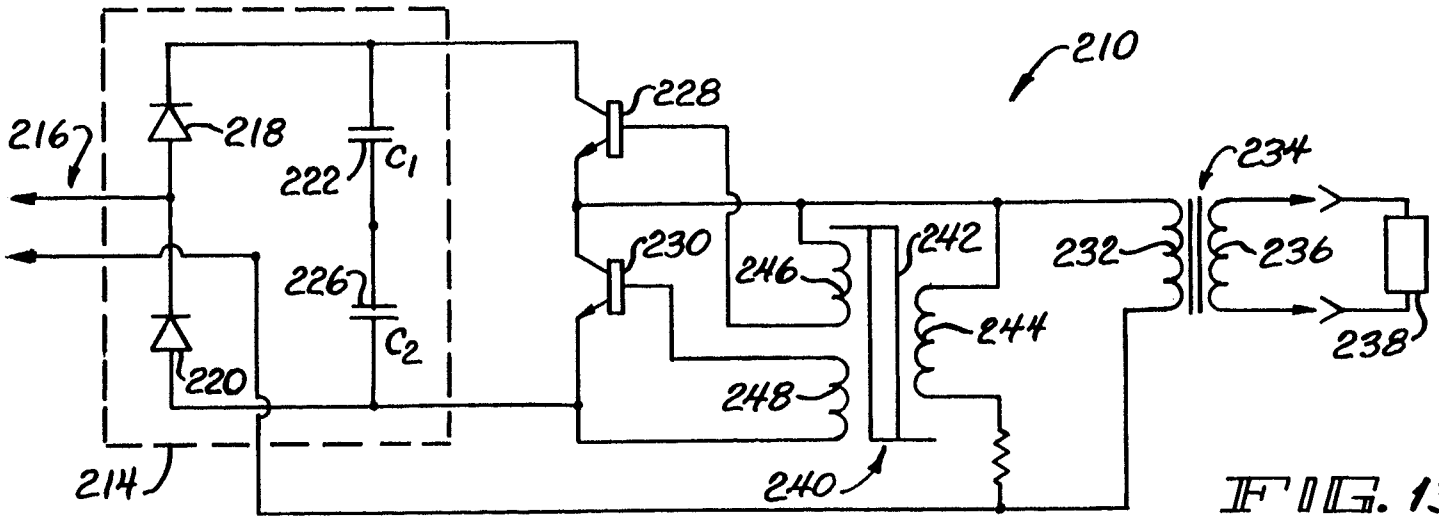
FIG. 13 is schematic diagram of an alternative arrangement for the symmetrically switched asymmetrical current power supply of the present invention.
Figure 14:
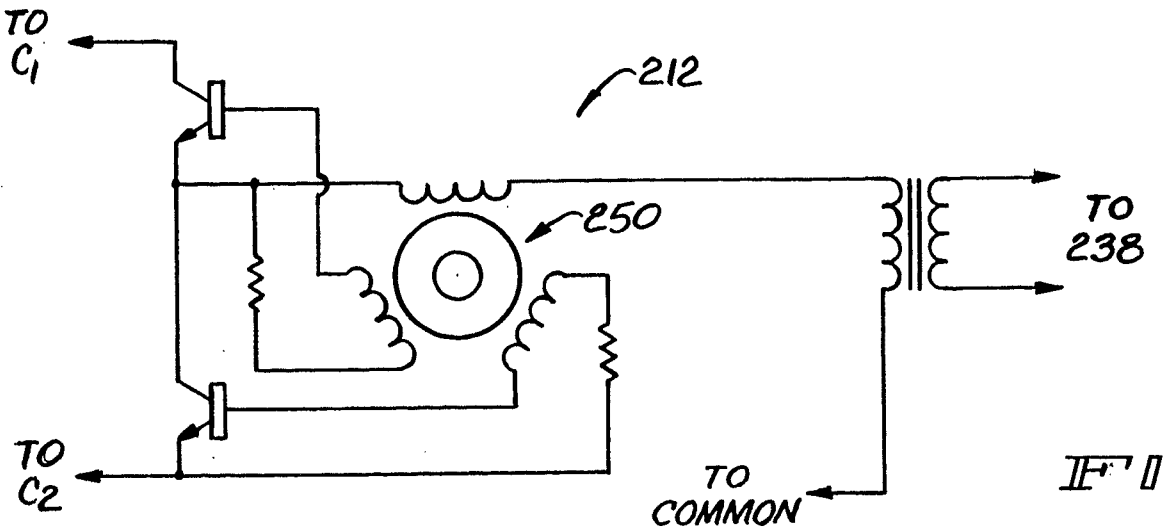
FIG. 14 is a schematic diagram of another alternative arrangement for the symmetrically switched asymmetrical current power supply of the present invention.

FIGS. 13 and 14 illustrate two alternate arrangements 210 and 212, respectively, for achieving the symmetrically switched asymmetrical luminous tube current of the present invention. These embodiments, respectively, represent parallel and series saturable reactor feedback oscillator implementations to achieve the periodically (symmetrically) reversing asymmetrical luminous tube current function.

Each relies on the use of a modified, but otherwise conventional, voltage doubler 214 connected to AC mains 216 and comprising rectifier diodes 218 and 220 and filter capacitors 222 or $C_1$ and 224 or $C_2$. Capacitors 222 and 226 are not conventional, however. The capacitance of these capacitors is undersized, that is, well below the nominal capacitance required to effect full filtering. In fact, capacitance values are selected to insure substantial ripple, such as depicted in FIG. 15.

Referring again to FIG. 13, supply 210 includes a pair of push-pull switching transistors 228 and 230 connected to the primary 232 of output transformer 234, the secondary 236 of which is connected to the neon/mercury luminous gas tube load 238.

A second transformer 240, having a saturable core 242, is employed in the oscillator feedback path. The primary 244 of feedback transformer 240 is placed in parallel with the output transformer 234 while a pair of secondary windings 246 and 248 are provided, each connected to a base input of respective transistors 228, 230.

Figure 15:
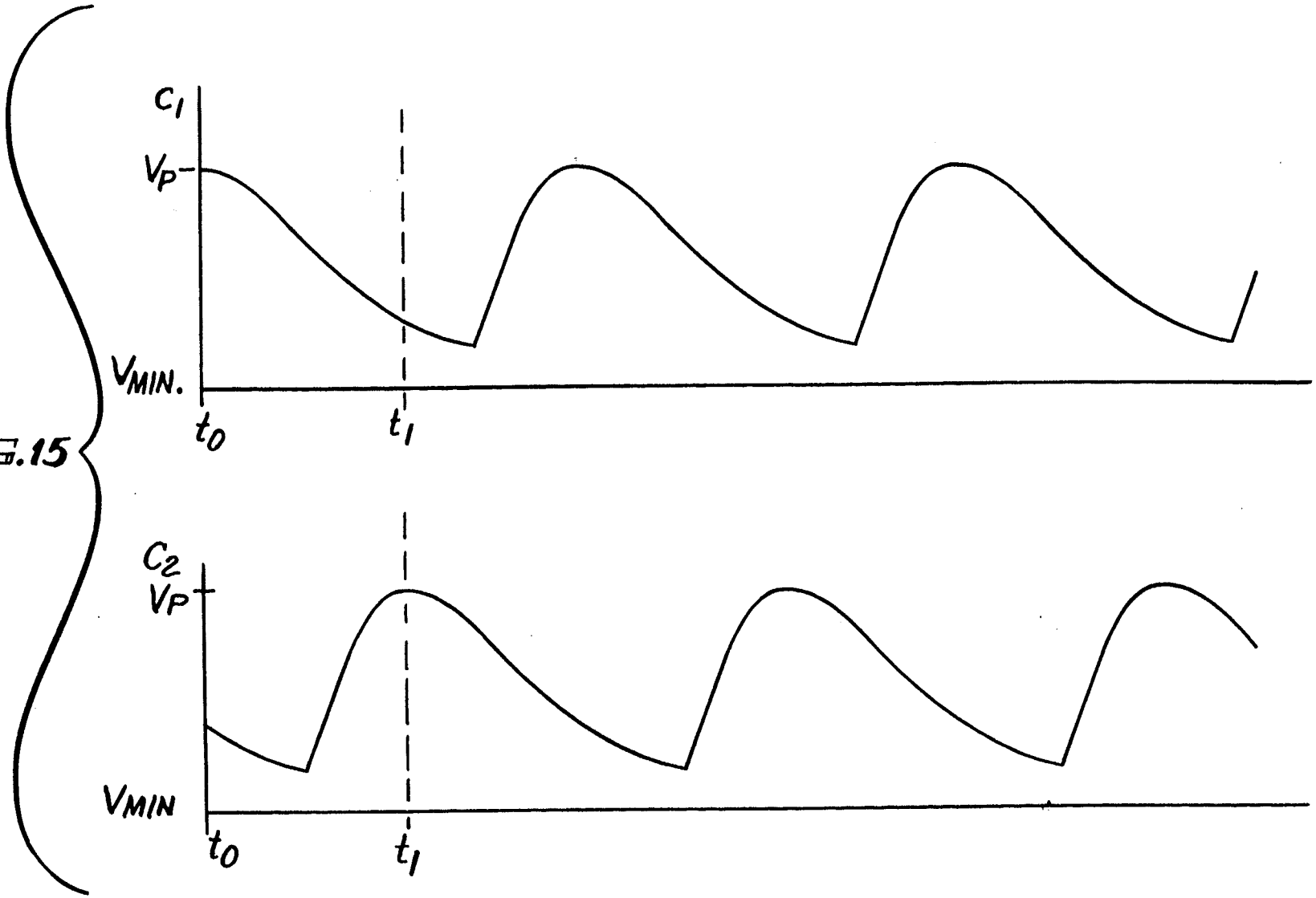
FIG. 15 are waveform diagrams of the voltages present across the filter capacitors of the power supplies of FIGS. 13 and 14.

Referring to FIG. 15, it will be observed that the voltage across both filter capacitors $C_1$ and $C_2$ are charged to the peak line voltage during respective half-cycles but, due to their under-sized nature, these capacitors thereafter discharge to a substantially lower voltage, $V_{min}$, awaiting the next charge cycle. It will also be apparent that the respective capacitor voltage waveforms are 180 degrees out of phase, each being charged to its peak voltage while the other is reaching its minimum voltage. Finally, it should be remembered that these are "low frequency" waveforms being derived, as noted, from the cyclic, i.e. 60 Hz, charging of the AC power main input.

Operation of oscillator 210 is best understood by reference to FIGS. 13 and 15. At time $t_0$ the voltage across capacitor $C_1$ is maximum while the voltage across capacitor $C_2$ is near minimum. Thus, during those half-cycles (i.e. high frequency cycles, remembering that oscillator 210 is essentially a high frequency oscillator operating at approximately 25 Khz) in which transistor 228 is turned-on, i.e. saturated, and transistor 230 is turned-off, i.e. cut-off, significantly more voltage will be placed across the primary of output and feedback transformers 234 and 240 than during the corresponding opposite half-cycles in which transistors 228 and 230 are "off" and "on", respectively.

As noted, transformer 240 is of the saturable core variety, being selected to saturate during each high frequency half cycle. Until saturation occurs, transformer 240 functions in the normal manner, that is, voltages are induced in the secondary windings which serve to bias one of the oscillator transistors "on" while the other is "off". Once saturation is reached, however, no further base drive is available to the "on" transistor thereby forcing turn-off of that device. The resulting magnetic field collapse induces an opposite polarity voltage in the secondary windings 246 and 248 thereby turning "on" the second transistor which remains on until core saturation is again achieved. In this manner oscillation is sustained.

The specific time required to force each core saturation cycle depends on the voltage across the primary 244 of the transformer which, in part, is a function of which transistor is turned "on". As noted, at time $t_O$ the voltage across the primary of transformer 240 is greater during the positive half-cycles (i.e. transistor 228 is "on") than during the negative half-cycles (i.e. transistor 230 is "on") thereby causing a correspondingly more rapid turn-off of transistor 228 than transistor 230. In this manner, an asymmetrical high frequency waveform is generated which, as discussed, results in the visible disappearance of neon bubbles.

It will be appreciated that this asymmetry will be periodically reversed in accordance with the line frequency waveforms of FIG. 15. More specifically, at time $t_1$, one-half line cycle latter, the positive half-cycles will be of greater duration due to the lower voltage across capacitor $C_1$ as compared to capacitor $C_2$. In this way, a symmetrically reversing asymmetrical waveform may be generated in an efficacious, inexpensive, and reliable manner.

FIG. 14 illustrates an alternative arrangement for the above-described saturable core symmetrically reversing asymmetrical oscillator in which the configuration of the saturable core feedback transformer 240 is changed from parallel configuration depicted in FIG. 13 to a series configuration as shown at 250 in FIG. 14. The operation of the oscillators of FIGS. 13 and 14 are otherwise the same.

Figure 16:
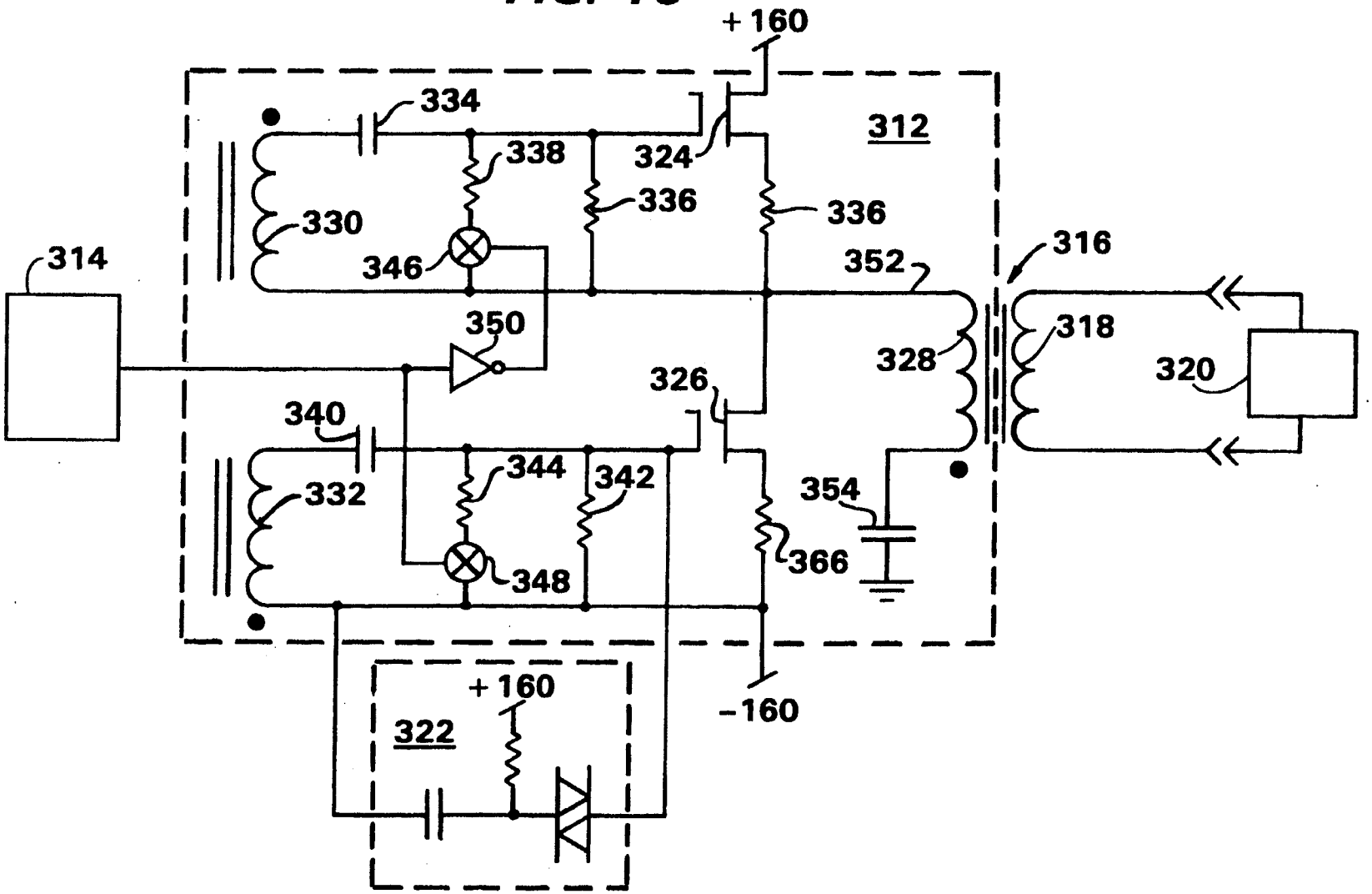
FIG. 16 is a partial schematic and partial block representation of yet another alternative arrangement for the symmetrically switched asymmetrical current power supply of the present invention.

Yet another embodiment of the symmetrically switched asymmetrical luminous tube power supply of the present invention is illustrated at 310 of FIG. 16. Supply 310 includes, in principal part, a free-running asymmetrical high frequency oscillator 312, a low frequency phase-reversing oscillator 314, and a high frequency/voltage step-up transformer 316, the secondary winding 318 of which is connected to a luminous tube load 320. Power supply 310 is preferably connected to a source of $+/-160$ $V_{dc}$ (not shown) and further includes a start-up circuit 322 of conventional configuration to assure proper supply operation upon initial power-up.

Oscillator 312 is a multivibrator in which two power FETs 324 and 326 are alternately switched into conduction, in turn, alternately interconnecting the primary winding 328 of transformer 316 to the +160 and −160 $V_{dc}$ sources, respectively. Oscillation is sustained by reason of the voltages induced in a pair of transformer feedback windings 330 and 332 which voltages are thereafter coupled through respective RC networks to the inputs of FETs 324,326. More specifically, feedback winding 330 is coupled to FET 324 through the RC network comprising capacitor 334, resistor 336 and, as explained in more detail hereinafter, periodically, resistor 338. Similarly feedback winding 332 is coupled to FET 326 through capacitor 340, resistor 342, and, periodically, resistor 344.

The frequency of power supply operation is determined in accordance with the time constants of these two RC networks. For operation between 20–25 Khz, for example, typical component values would be 0.047 μfd for capacitors 334,340; 3KΩ for resistors 336 and 342; and 1.5KΩ for resistors 338 and 344.

Electronic switches 346 and 348 function to selectively and alternately place resistors 338 and 344 in parallel with respective resistors 336 and 342. The low frequency signal from oscillator 314 is inverted at 350 and the resulting pair of out-of-phase signals (i.e. non-inverted and inverted) are applied to the respective gate inputs of switches 346 and 348.

Figure 18:
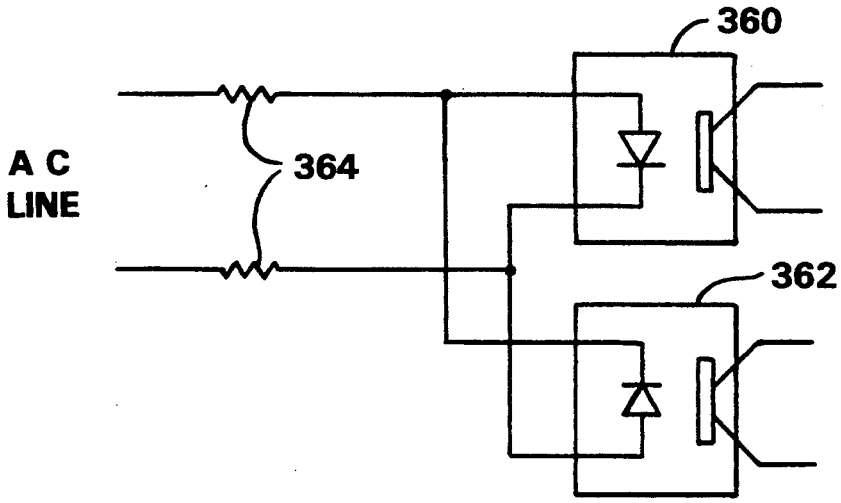

Although virtually any electronic switch may be used, opto-isolators 360 and 362 (FIG. 18) have been employed to effect the requisite switching function while advantageously also providing power supply isolation from the low frequency phase-reversing oscillator 314. This latter isolation feature is particularly beneficial where, as proposed herein, the low frequency oscillator function is efficaciously and inexpensively achieved by placing opto-isolators 360 and 362, with appropriate current-limiting resistors 364, 'back-to-back' across a standard 60 Hz power line source. In this manner a separate invertor 350 is not required as the back-to-back configuration makes these switch elements inherently responsive to opposed half-cycles of the AC input waveform. It will be further understood that the threshold diode drop, $V_{be}$, of the opto-isolators provides a 'dead-zone' at the zero-crossing of the AC line input thereby precluding any possibility of simultaneous enablement of both opto-isolators.

In view of the foregoing, it will be apparent that switch 346/360 is "on" while switch 348/362 is "off" and visa versa. Thus, the feedback RC time constant to one FET 324,326 will be $T_1=(R_1 \cdot C)=(1K\Omega \cdot C)$ (i.e. C times the parallel combination of both resistors) while the RC time constant to the other FET will be $T_2=(R_2 \cdot C)=(3K\Omega \cdot C)$ (i.e. C times resistor 336 or 342, alone). It will be appreciated that this RC time constant relationship will be reversed twice during each cycle of the low frequency oscillator 314 (i.e. FETs 324,226 will each experience 50/50 duty cycle operation at $T_1$ and $T_2$).

Figure 17:
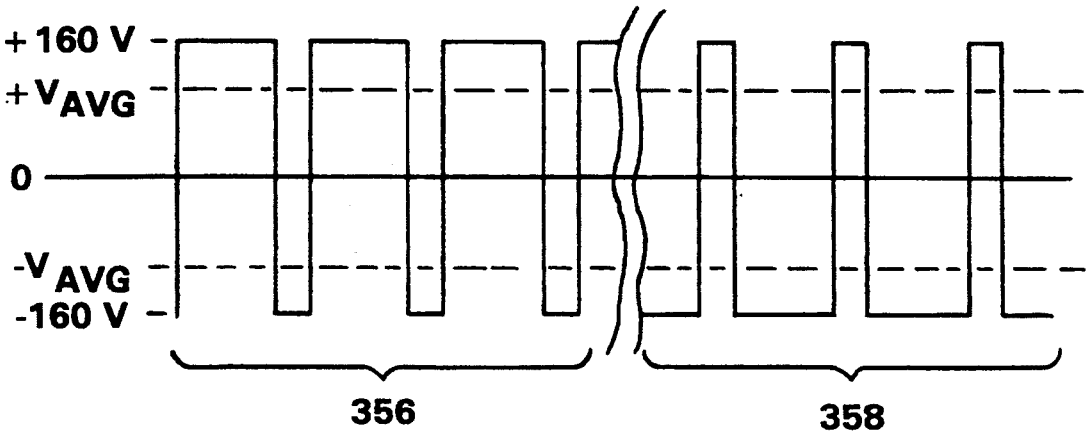
FIG. 17 is waveform diagram of the symmetrically switched asymmetrical voltage output from the FET switches of FIG. 16; and, FIG. 18 is a schematic diagram of the opto-isolator embodiment of the low frequency switching arrangement of FIG. 16.

FIG. 17 illustrates the voltage waveform seen at the output 352 of FETs 324,326 which voltage is impressed across the series combination of transformer primary 328 and capacitor 354. The first interval shown, at 356, corresponds to the half-cycle of oscillator 314 in which switch 346 is 'off' and switch 348 is 'on'. During this interval, FET 324 remains 'on' for the longer time constant corresponding to $T_2$ while FET 326 remains 'on' the shorter $t_1$ period. Similarly, during the second interval or half-cycle of oscillator 314, characterized by switch 346 being 'on' and switch 348 11 being 'off', it will be FET 326 that experiences the longer $T_2$ 'on' pulse width. This is shown as interval 358 of FIG. 17. In this manner a symmetrically reversing, non-symmetrical waveform is produced thereby minimizing, as set forth above, problems of bubble formation and mercury migration.

Referring again to FIG. 17, it will be seen that the non-symmetrical waveforms corresponding to the alternating half-cycles of oscillator 314 result in corresponding DC offset voltages of $+V_{avg}$ and $-V_{avg}$ for intervals 356 and 358, respectively. Capacitor 354 is placed in series with the step-up transformer primary winding 328 and serves to block the above-noted low frequency DC offset energy (i.e. 60Hz) from reaching the transformer primary while acting as a by-pass for the high frequency oscillator energy (i.e. for 25KHz). A 0.1 μfd capacitor is typical.

Resistors 366 are placed in the source leads of FETs 324,326 and provide a source of negative feedback to oscillator 312. Resistors 366 may be in the order about 1Ω. This negative feedback, in cooperation with the leakage reactance of step-up transformer 316, importantly serves to lessen power supply sensitivity to unpredictable or changing Icad 320 conditions.

I claim:

1. A high frequency power supply for neon and mercury gas tube loads including a high frequency transformer having primary and high-voltage secondary windings, means for connecting the secondary winding to a gas tube load for passing a current therethrough; DC input means for connection to a source of DC power; a high frequency oscillator connected to the DC input means and to the primary of the transformer for applying, alternately, first and second asymmetrical voltage waveforms to said primary transformer winding, the first and second waveforms being substantially reverse polarity images of one another; controller means operatively connected to the high frequency oscillator for effecting the alternate application of the first and second waveforms to the transformer primary in response to a control signal input thereto; low frequency oscillator means operatively connected to the control means signal input whereby the first and second asymmetrical high frequency waveforms are alternately applied to the transformer and to a gas tube connected thereto at a low frequency rate whereby the current through a gas tube load is at all times asymmetrical but where the long-term current waveform through the load is symmetrical thereby eliminating visible neon bubble formation and minimizing migration of mercury gas atoms.

2. A high frequency power supply for neon and mercury gas tube loads including a high frequency transformer having primary and high-voltage secondary windings, means for connecting the secondary winding to a gas tube load for passing a current therethrough; DC input means for connection to a positive and negative source of DC power; a high frequency oscillator connected to the positive and negative DC input means and to the primary of the transformer for applying high frequency waveforms to the primary transformer winding; the high frequency oscillator including first and second output switch means between the primary winding and the positive and negative DC input means, respectively, and feedback means for alternately turning-on the first and second output switch means whereby the high frequency waveform is applied to the primary, the feedback means including timing means for selectively setting the respective high frequency turn-on durations of the first and second output switch means, the timing means defining at least two selectable turn-on durations; a low frequency oscillator means; control means operatively connected to the low frequency oscillator means and to the timing means for setting the respective turn-on durations of the output switch means for each half cycle of the low frequency oscillator means, the first output switch means being enabled for one turn-on duration while the second output switch means is enabled for the other turn-on duration, said respective turn-on durations being reversed between the output switch means during each subsequent half cycle of the low frequency oscillator means whereby asymmetrical high frequency waveforms are alternately applied to the transformer and to a gas tube connected thereto at a low frequency rate whereby the current through a gas tube load is at all times asymmetrical but where the long-term current waveform through the load is symmetrical thereby eliminating visible neon bubble formation and minimizing migration of mercury gas atoms.

3. The high frequency power supply for neon and mercury gas tube loads of claim 2 in which the timing means includes first and second RC networks between the feedback means and the first and second output switch means, respectively; each RC network including at least three elements, said elements being either electrical resistors or electrical capacitors and the three elements including at least one of each element type, and an RC time-constant switch means for selectively disabling at least one of said elements whereby the time-constant thereof and the turn-on duration of the associated output switch means changes correspondingly; the low frequency oscillator means being operatively connected to the time-constant switch means whereby an asymmetrical waveform is applied to the transformer primary and to a gaseous load and the phase of said waveform is periodically reversed in response to the low frequency oscillator means.

4. The high frequency power supply for neon and mercury gas tube loads of claim 3 in which each RC time-constant switch means is an opto-isolator having a control diode input and a switch output, the switch output thereof being operatively connected to the respective RC network and the control diode input being connected to the low frequency oscillator means.

5. The high frequency power supply for neon and mercury gas tube loads of claim 3 in which the low frequency oscillator means is the AC line power source.

6. The high frequency power supply for neon and mercury gas tube loads of claim 4 in which the low frequency oscillator means is the AC line power source and the opto-isolator control diode inputs are operatively connected to the AC line power source, the respective control diodes inputs of the opto-isolators being interconnected back-to-back in reverse polarity whereby one and only one of said diodes will be conducting current therethrough during each half-cycle of the AC line input and each of said diodes will conduct during alternating AC line half-cycles whereby the associated switches will alternately be enabled thereby correspondingly changing the on-durations of the respective output switch means.

7. The high frequency power supply for neon and mercury gas tube loads of claim 2 including a resistance in series with each of the output switch means, the resistance causing generation of a negative high frequency oscillator feedback whereby proper power supply operation occurs over wider load conditions.

* * * * *